US012538994B2

(12) United States Patent
deGruchy

(10) Patent No.: US 12,538,994 B2
(45) Date of Patent: Feb. 3, 2026

(54) FOOD TRAYS IN THE SHAPE OF A SPORTS STADIUM

(71) Applicant: Astrid Elizabeth deGruchy, Islamorada, FL (US)

(72) Inventor: Astrid Elizabeth deGruchy, Islamorada, FL (US)

( * ) Notice: Subject to any disclaimer, the term of this patent is extended or adjusted under 35 U.S.C. 154(b) by 0 days.

(21) Appl. No.: 18/779,036

(22) Filed: Jul. 21, 2024

(65) Prior Publication Data

US 2026/0020705 A1 Jan. 22, 2026

(51) Int. Cl.
*A47G 23/06* (2006.01)
*B65D 5/44* (2006.01)

(52) U.S. Cl.
CPC ..... *A47G 23/06* (2013.01); *B65D 5/445* (2013.01); *B65D 2203/00* (2013.01); *B65D 2313/10* (2013.01)

(58) Field of Classification Search
CPC .... A47G 23/06; B65D 5/445; B65D 2203/00; B65D 2313/10
USPC ..... 206/557; 229/902, 904, 906
See application file for complete search history.

(56) References Cited

U.S. PATENT DOCUMENTS

| | | | | |
|---|---|---|---|---|
| 2,476,102 | A * | 7/1949 | Lobell | B65D 5/5213 229/117.22 |
| 5,381,901 | A * | 1/1995 | Hundley | B65D 1/36 220/675 |
| D426,402 | S * | 6/2000 | Rutledge | D6/678.2 |
| 6,401,927 | B1 * | 6/2002 | Sorensen | B65D 5/5286 273/286 |
| 2006/0042989 | A1 * | 3/2006 | Suter | B65D 5/5007 229/407 |
| 2016/0107791 | A1 * | 4/2016 | Schlief | A47G 23/06 220/4.28 |

* cited by examiner

*Primary Examiner* — Jacob K Ackun
(74) *Attorney, Agent, or Firm* — Talem IP Law, LLP

(57) ABSTRACT

The present invention is a stadium-shaped food tray designed to enhance the presentation and serving of snacks and dips at sports events and other occasions. The tray is formed using a base, a compartment sheet having cutouts and creases, an outer compartment wall, and supports. The tray is constructed from lightweight materials and, when assembled, features multiple fitted compartments for organizing various food items. Customizable elements allow users to change colors and add branding, making the tray suitable for specific events and promotional purposes.

10 Claims, 4 Drawing Sheets

FOOD TRAYS IN THE SHAPE OF A SPORTS STADIUM

BACKGROUND

Field of the Invention

This invention pertains to food-grade containers and, more specifically, to containers designed for both serving and displaying snacks and dips. One objective of the invention is to create a container that serves both as a serving unit and a display for the food items it holds. Another objective is to design a container with a structure that includes multiple fitted compartments. These compartments, arranged to mimic the seating and layout of a sports stadium, allow the snacks and dips to be prominently displayed, enhancing the thematic experience of sports gatherings.

Description of Related Art

Traditional food containers used for serving snacks and dips lack the visual appeal and thematic elements that enhance the enjoyment of food during sports events. There is a need for an innovative serving container that not only fulfills its practical purpose but also contributes to the excitement and atmosphere of the occasion. Due to the unique design and thematic features of this invention, finding prior art is limited, underscoring the novelty and originality of the proposed solution.

In the search for prior art relevant to innovative food displays for sporting events, the closest matches found are Food and Beverage Tray, U.S. Patent Application Publication [US 2006/0042989 A1] to Suter et al. (2006), and U.S. Pat. No. 2,476,102 (1948) to Lobell et al. These existing solutions do not address the combination of thematic design and functional compartments that is offered by the present invention.

BRIEF SUMMARY OF INVENTION

The present invention is a food tray with a unique design inspired by a sports stadium.

This tray includes multiple compartments for organizing and serving snacks and dips, enhancing the thematic presentation for users. The tray is designed to be assembled in steps and is provided with an instruction manual to assist users in the optimal setup and use of the tray.

The food tray includes a base; a compartment sheet having cutouts with creases for bending on a front side; an outer compartment wall; and cross-side supports; wherein the compartment sheet attaches on a back side to the base, wherein the cutouts of the compartment sheet bend at the creases to form a first wall for an inner region and a second wall for a compartment region between the first wall and the second wall on the front side, wherein the outer compartment wall attaches to the base around a perimeter of the compartment region of the compartment sheet, the outer compartment wall forming an outer compartment region between the second wall and the outer compartment wall, and wherein the cross-side supports form compartments in the compartment region and the outer compartment region, each cross-side support attaching to the first wall and the outer compartment wall across a corresponding groove in the second wall.

The food tray designed with a sports stadium theme offers several advantages, including an enhanced thematic experience that adds to the enjoyment of sports events. Its unique design features multiple compartments for effective organization of snacks and dips, minimizing mess and simplifying access. With a user-friendly step-by-step assembly process and versatility for various food items, the tray is both practical and adaptable. The attractive stadium design not only improves visual presentation but also ensures durability, holding food items securely and maintaining its shape. This innovative approach distinguishes the tray from standard serving solutions, providing a distinctive option for themed food presentation.

BRIEF DESCRIPTION OF THE DRAWINGS

In the drawings, closely related figures have the same number but different alphabetic suffixes.

DETAILED DESCRIPTION

The present invention is a food tray with a unique design inspired by a sports stadium. The innovative food tray designed for enhancing the presentation and serving of snacks and dips, includes a base and a plurality of fitted compartments formed on the base, wherein the food tray is constructed in the shape of a sports stadium, providing a thematic and engaging appearance.

The compartments can be specifically configured to hold and organize various types of snacks and dips, preventing mixing and ensuring easy access. The compartments are formed by tab inserts that are designed to fold and interlock with the base, facilitating easy assembly and structural integrity. In embodiments, the compartments are specifically configured to prevent the mixing of different food items, ensuring that each type of food remains separate and organized.

The food tray can include customizable decorative elements that enhance the visual appeal of the tray. The tray is designed to be customizable in terms of colors and branding, allowing users to enjoy the tray for specific events, team colors, or corporate branding. The decorative elements can include signs and goal posts that can be adjusted or decorated to match specific themes or preferences.

An instruction manual is provided to guide users through a step-by-step assembly process, ensuring correct and efficient assembly of the tray. The materials used in the construction of the tray are lightweight, allowing for easy portability and convenient transportation to different locations. In embodiments, the tray is designed for straightforward assembly, allowing for efficient storage and easy transportation as a single, integrated unit.

Figure 1:
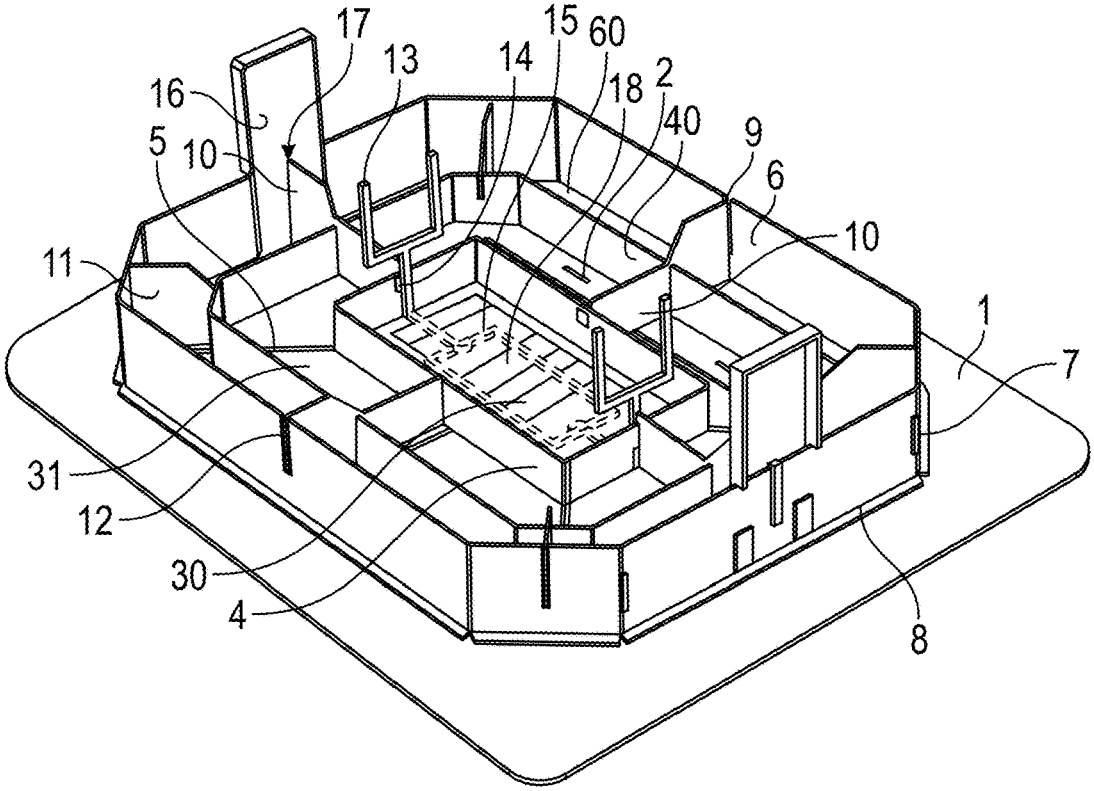
FIG. 1 shows the fully assembled stadium-shaped food tray, highlighting the complete structure and arrangement of parts.
Figure 2:
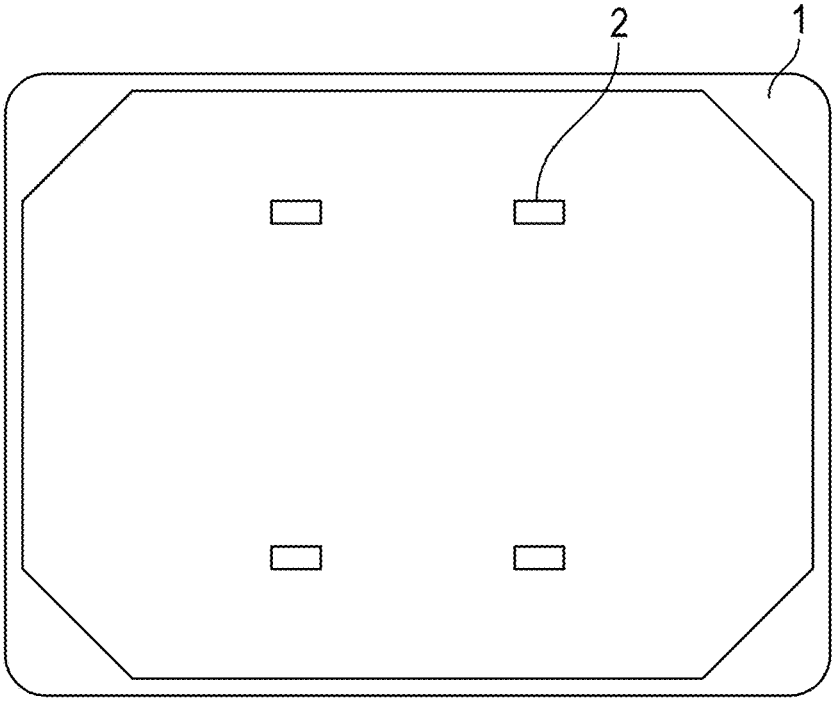
FIG. 2 depicts the base of the tray and the four tab inserts, indicating their positions for attaching the compartment sheet shown in FIG. 3.
Figure 3:
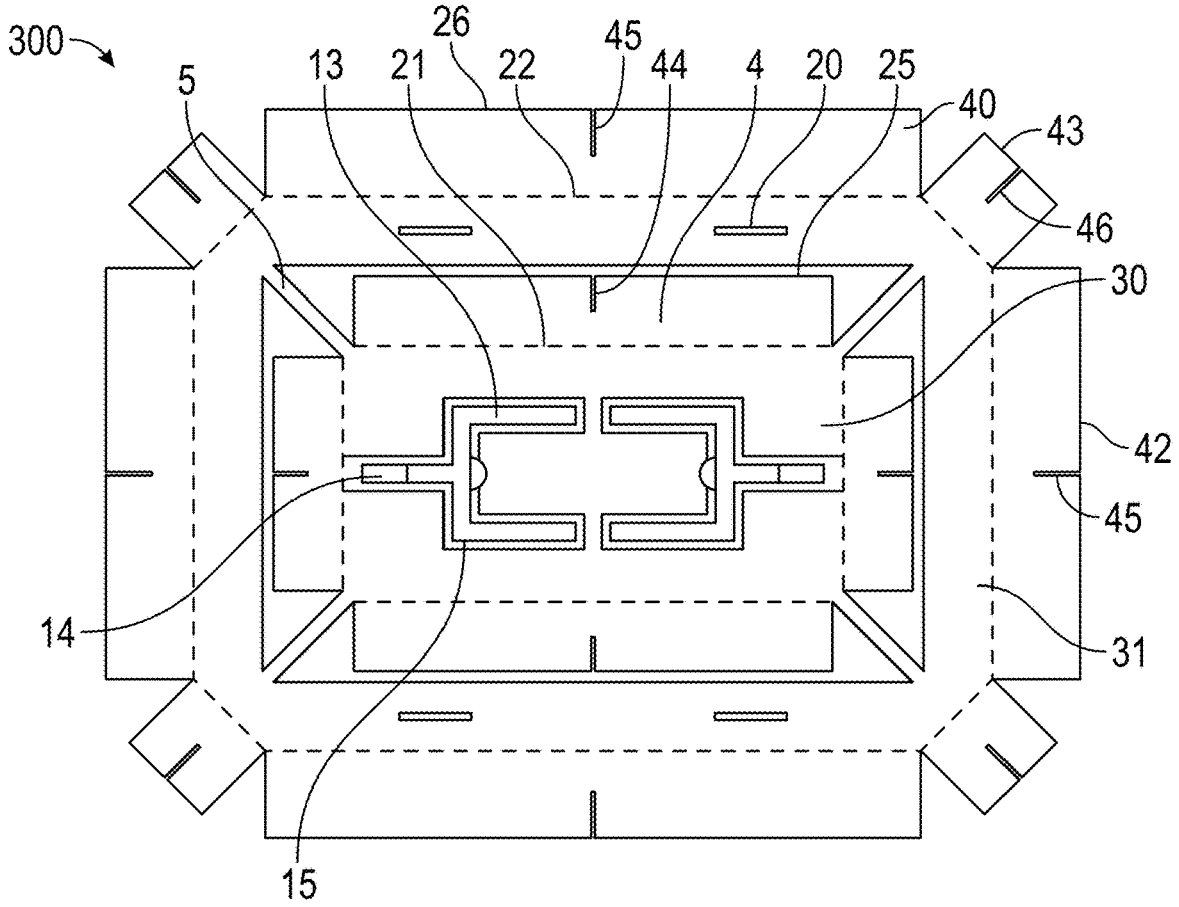
FIG. 3 illustrates a compartment sheet for the construction and attachment of compartments to the base using the tabs from FIG. 2.
Figure 4:
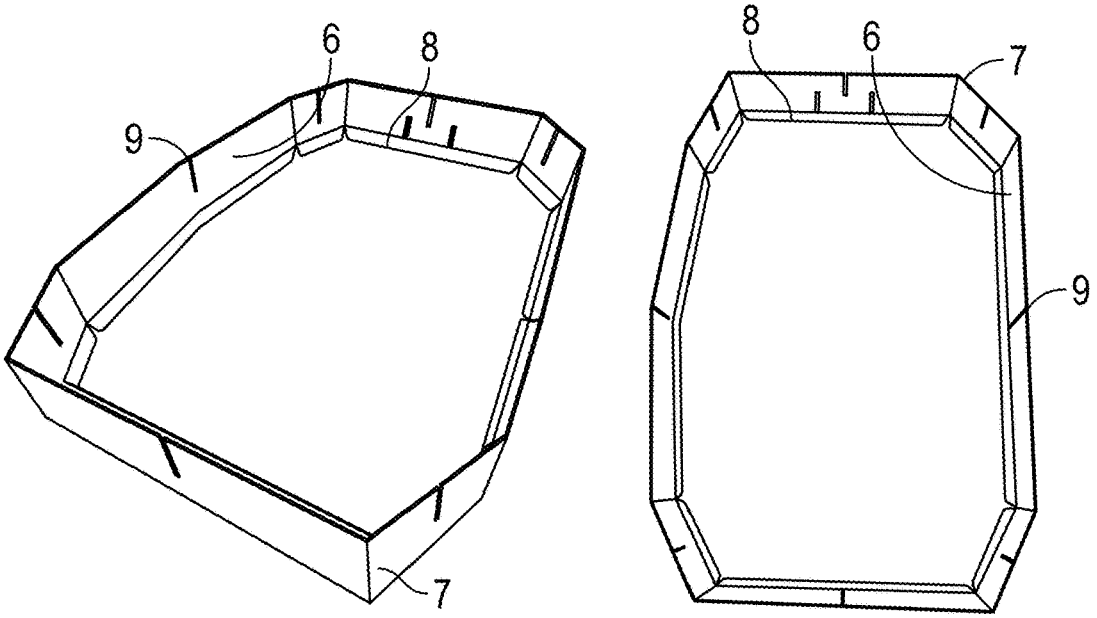
FIGS. 4A & 4B show views of an assembled outer compartment wall.
Figure 5A:
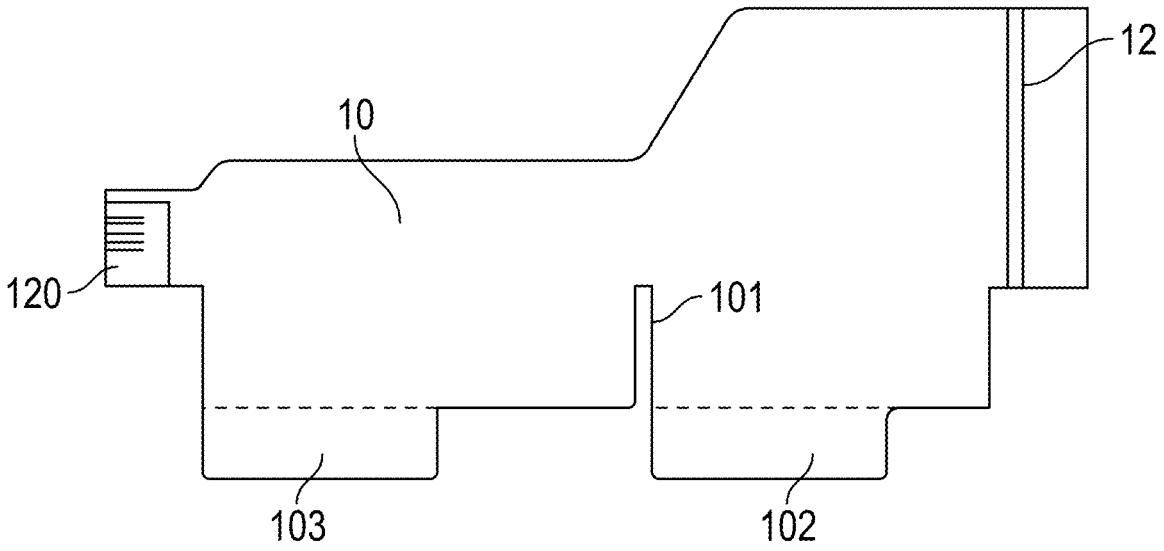
FIGS. 5A & FIG. 5B depict structural components.
Figure 5B:
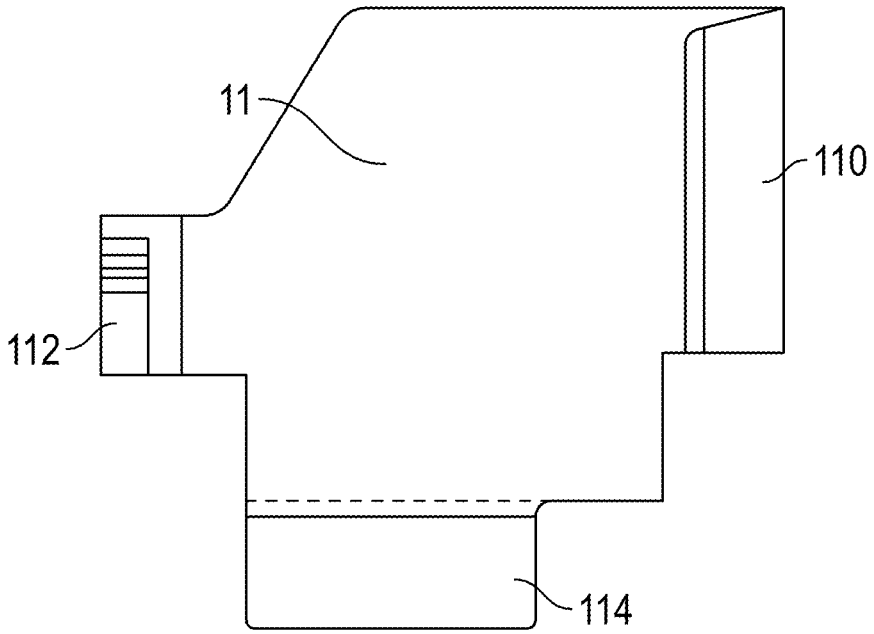

FIG. 1 shows the fully assembled stadium-shaped food tray, highlighting the complete structure and arrangement of parts' FIG. 2 depicts the base of the tray and the four tab inserts, indicating their positions for attaching the compartment sheet shown in FIG. 3; FIG. 3 illustrates a compartment sheet for the construction and attachment of compartments to the base using the tabs from FIG. 2; FIGS. 4A & 4B show views of an assembled outer compartment wall; and FIGS. 5A & FIG. 5B depict structural components. As is apparent from the figures, the base 1 shown in FIG. 2, the compartment sheet 300 shown in FIG. 3, the outer compartment wall shown assembled in FIG. 4A & FIG. 4B; and the cross-side supports shown in FIG. 5A & FIG. 5B are able to be flattened for transport before assembly.

The fully constructed food tray is displayed in FIG. 1, illustrating the interconnection of all components shown in the other figures. As can be seen, the food tray is constructed in the shape of a sports stadium, providing a thematic and engaging appearance. FIG. 2 shows the base 1, which is flat, with a cut tab 2 that can be pushed up from a preformed bend. The tab 2 also includes adhesive tape to interlock with components from FIG. 3 (see slot 20 through which tab 2 can be pushed up through). The compartment sheet 300 is shown in FIG. 3, which allows for the construction and attachment of compartments to the base 1 using the tabs 2 from FIG. 2 through the slots 20. The compartment sheet 300 includes various cuts and creases, including cutouts 25 and creases 21 for first wall 4 and cutouts 26 and creases 22 for second wall 40. The first wall 4 includes side pieces 41. The second wall 40 includes side pieces 42 and corner pieces 43. Each side piece 41 of the first wall 4 includes a groove 44. Each side piece 42 of the second wall includes a groove 45 and each corner piece 43 of the second wall 40 includes a groove 46. When the cutouts 25 and 26 are bent at the creases 21 and 22, an inner region 30 is defined within the first wall 4 and a compartment region 31 is defined between the first wall 4 and the second wall 40.

The compartment sheet 300 also includes cutouts for goal posts 13, which include adhesive tabs 14 for attaching to the first wall 4. Referring to FIGS. 1 and 3, the compartmental walls formed of first wall 4 and second wall 40 push up from creases (e.g., creases 21, 22) in the sheet 300, forming part of the eight compartments. All compartmental walls in FIG. 3 are connected to the same base, with specialized cuts separating the base from the inner compartment walls 4, 40. A portion of the compartment sheet 300 can be removed from where the first wall 4 has a cut from the compartment sheet 300 and a piece 5 of the compartment sheet 300 connects the part with the first wall 4 to the part with the second wall 40 and slots 20 so that the inner region 30 is able to connect to the base 1 via the tabs 2 in slots 20.

Goal posts 13 can be formed by precision cuts 15 and are held up by adhesive tabs 14, ensuring that they remain in place and provide a realistic appearance. The goal posts 13 can fold backward to enable attachment to the first wall 4.

Referring to FIGS. 4A & 4B, an outer compartment wall 6 can form an enclosed shape at connection point 7. As shown in FIG. 1, the outer compartment wall 6 wraps around the second wall 40 (e.g., an outer perimeter of compartment region 31) of the compartment sheet 300 in order to form an outer compartment region 60 between the second wall 40 and the outer compartment wall 40. The outer compartment wall 6 is used to add more compartments beyond the central ones formed from the compartment sheet 300. The outer compartment wall 40 is secured to the base 1 using a folded bottom 8 with adhesive. The outer compartment wall 6 includes grooves 9 for structural components from FIG. 5A & FIG. 5B.

FIG. 5A & FIG. 5B depicts structural components that provide structural integrity and reinforce the compartments in FIG. 1. Referring to FIG. 5A, a cross-side support 10 is shown that can attach to the first wall 4 and the outer compartment wall 6 across a corresponding groove 45 in the second wall 40. The cross-side support 10 attaches to the first wall 4 using tab 120 in groove 44. The cross-side support 10 attaches to the outer compartment wall 6 using tab 12 in groove 9. The cross-side support 10 fits across the second wall with a slot attachment mechanism using slot 101 of the cross-side support 10 and the corresponding groove 45 in the second wall 40. Parts 102 and 103 can fold to attach to outer compartment region 60 and compartment region 31. Once in place, the cross-side supports 10 form compartments in the compartment region 31 and the outer compartment region 60.

Referring to FIG. 5B, a cross-angle support 11 is shown that can attach to the second wall 40 and the outer compartment wall 6 at corner regions of the outer compartment region 60 (e.g., in the outer corners). The cross-angle support 11 attaches to the outer compartment wall 6 using tab 110 in a corresponding groove 9 of the outer compartment wall 6. The cross-angle support 11 attaches to the second wall 40 using tab 112 in a corresponding groove 46 of corner piece 43. Part 114 can fold to attach to outer compartment region 60.

As can be seen, the food tray can include structural components that provide additional stability to the tray, enhancing overall durability. Adhesive strips can be utilized to secure the structural components to the base and other parts of the tray, ensuring a robust and stable construction. The structural components can include reinforcement tabs that provide additional stability and support, enhancing the durability of the tray.

Figure 6:
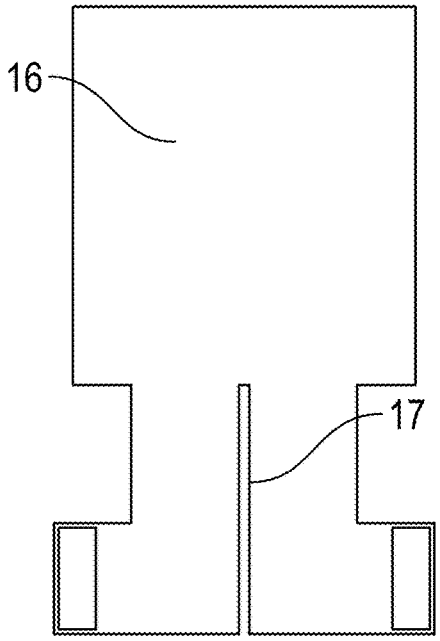
FIG. 6 illustrates a decorative sign.

FIG. 6 illustrates a decorative sign. Decorative signs 16, as seen in FIG. 6, include slit 17 that fits over a cross-side support (e.g., support 10) and be secured with adhesive backing like adhesive tab 12. As can be seen, customizable elements are inserted using pre-formed grooves and secured with adhesive backing, allowing for easy installation and removal.

Figure 7:
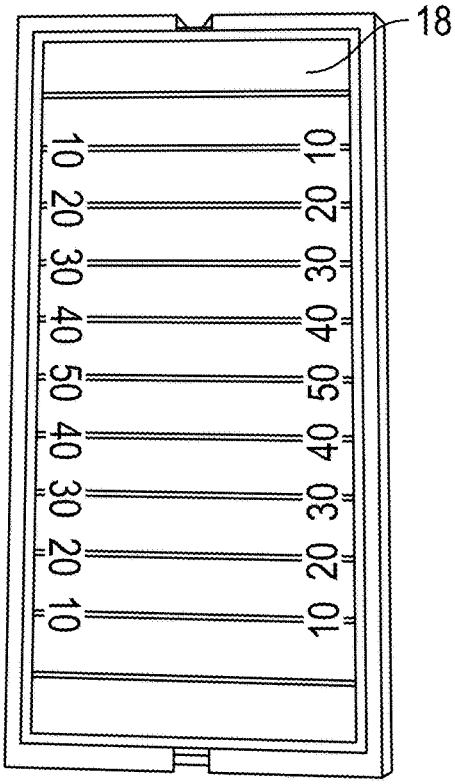
FIG. 7 shows a decorative insert.

FIG. 7 shows a decorative insert. Decorative insert 18 can be placed in the inner region 30 of the compartment sheet 300, but cut to form around the goal posts 13.

The innovative design of the stadium-shaped food tray offers several distinct advantages that enhance both functionality and user experience, particularly during sports events. The unique stadium shape adds an exciting and engaging element to any event, serving not only as a functional food tray but also as a decorative centerpiece that enhances the overall ambiance (FIG. 1). The tray features multiple fitted compartments, allowing for a well-organized presentation of various snacks and dips (FIGS. 3 and 4), preventing mixing and ensuring easy access. Its step-by-step construction process, accompanied by an instruction manual, ensures easy and quick assembly without confusion. The tray's structural components, including cross-sections and angular parts provide enhanced stability, with reinforcement tabs and adhesive strips ensuring secure connections and maintaining integrity even when loaded with food.

Furthermore, the tray's versatility makes it suitable for a wide range of snacks and dips, applicable for various occasions beyond sports events, such as parties, picnics, and gatherings. Its lightweight materials ensure portability, making it convenient to transport to different locations. Customizable elements, such as decorative signs (FIG. 6) and inserts (FIG. 7) allow for variations to suit specific themes. The ability to change colors and add branding further enhances the tray's appeal, allowing users to tailor the tray to specific events, team colors, or corporate branding. This customization adds a unique and personal touch, making the tray suitable for promotional purposes and enhancing the overall experience for users. The uniqueness of the stadium-shaped food tray, with limited prior art, underscores its innovative nature, making it a novel and exciting addition to the market. These advantages collectively make the stadium-shaped food tray a superior option for enhancing the food-serving experience at sports events and other occasions, combining practicality with aesthetic appeal.

In conclusion, the stadium-shaped food tray is an innovative solution designed to enhance the food-serving experience at sports events and other occasions. Its unique design, featuring multiple fitted compartments, not only organizes snacks and dips effectively but also adds an exciting thematic element to the event. The tray's easy assembly, structural stability, and portability make it a versatile and practical choice for various settings. Customizable elements, such as the ability to change colors and add branding, further enhance its appeal, making it suitable for promotional purposes. The limited prior art underscores the novelty of this invention, positioning it as a unique and valuable addition to the market. This food tray successfully combines functionality with aesthetic appeal, making it a superior option for consumers looking to enhance their event experiences.

I claim:

1. A food tray comprising:

a base;

a compartment sheet having cutouts with creases for bending on a front side;

an outer compartment wall; and cross-side supports;

wherein the compartment sheet attaches on a back side to the base, wherein the cutouts of the compartment sheet bend at the creases to form a first wall for an inner region and a second wall for a compartment region between the first wall and the second wall on the front side, wherein the outer compartment wall attaches to the base around a perimeter of the compartment region of the compartment sheet, the outer compartment wall forming an outer compartment region between the second wall and the outer compartment wall, and wherein the cross-side supports form compartments in the compartment region and the outer compartment region, each cross-side support attaching to the first wall and the outer compartment wall across a corresponding groove in the second wall.

2. The food tray of claim 1, wherein the food tray has a shape of a sports stadium.

3. The food tray of claim 1, wherein the compartments in the compartment region and the outer compartment region are configured to hold and organize various types of snacks and dips.

4. The food tray of claim 1, further comprising a decorative insert that fits into the inner region.

5. The food tray of claim 1, further comprising a decorative sign comprising a slit that fits over a cross-side support of the cross-side supports.

6. The food tray of claim 1, further comprising cross-angle supports that attach to the second wall and the outer compartment wall at corner regions of the outer compartment region.

7. The food tray of claim 1, further comprising customizable decorative elements.

8. The food tray of claim 1, wherein the compartment sheet further comprises cutouts in the inner region in a shape of goal posts, wherein the cutouts in the shape of goal posts fold backward to enable attachment to the first wall.

9. The food tray of claim 1, further comprising a plurality of adhesive strips for securing components in place, including securing the compartment sheet to the base, and the cross-side supports to the first wall and the outer compartment wall.

10. The food tray of claim 1, wherein the base, the compartment sheet, the outer compartment wall; and the cross-side supports are able to be flattened for transport before assembly.

* * * * *